United States Patent [19]

Blanc

[11] Patent Number: 4,767,238

[45] Date of Patent: Aug. 30, 1988

[54] METHOD OF ACCURATELY POSITIONING A PREFABRICATED STRUCTURE ON THE SEA BED OR ON A RIVER BED BY GROUNDING, AND A SEA OR A RIVER CONSTRUCTION OBTAINED BY SAID METHOD

[75] Inventor: Pierre Blanc, Aix-en-Provence, France

[73] Assignee: GTM-Entrepose, Nanterre, France

[21] Appl. No.: 3,490

[22] Filed: Jan. 15, 1987

[30] Foreign Application Priority Data

Jan. 15, 1986 [FR] France ..... 86 00482

[51] Int. Cl.[4] ..... E02B 17/02; E01D 21/00

[52] U.S. Cl. ..... 405/207; 405/209; 405/203; 14/77

[58] Field of Search ..... 405/195, 203–210, 405/211, 222, 224, 225, 8, 11, 13, 14; 14/1, 18, 75, 77

[56] References Cited

U.S. PATENT DOCUMENTS

| | | | |
|---|---|---|---|
| 53,919 | 4/1866 | Gilmore | 405/13 |
| 1,850,507 | 3/1932 | Larsson | 14/1 |
| 3,091,089 | 5/1963 | Gellerstad | 405/206 |
| 3,259,932 | 7/1966 | Patin | 14/18 |
| 3,464,212 | 9/1969 | Yamagata et al. | 405/204 |
| 3,704,595 | 12/1972 | Launay | 405/205 X |
| 4,283,159 | 8/1981 | Johnson et al. | 405/203 X |
| 4,290,716 | 9/1981 | Lamy | 405/203 |
| 4,310,052 | 1/1982 | Rivertz | 405/203 X |
| 4,422,803 | 12/1983 | Wetmore | 405/207 X |
| 4,504,172 | 3/1985 | Clinton et al. | 405/195 X |

FOREIGN PATENT DOCUMENTS

| | | | |
|---|---|---|---|
| 1189331 | 6/1985 | Canada | 405/205 |
| 2386648 | 12/1978 | France | 405/195 |

*Primary Examiner*—Randolph A. Reese
*Assistant Examiner*—John A. Ricci
*Attorney, Agent, or Firm*—Gottlieb, Rackman & Reisman

[57] ABSTRACT

A method consists in at least partially surrounding a prefabricated structure by means of a floating caisson while leaving a gap of several meters between the caisson and the structure. Then, when the floating assembly constituted by the caisson and the structure is located at the site where the structure is to be grounded, the assembly is positioned and oriented approximately and the caisson is grounded on the sea bed or on a river bed by ballasting. Thereafter, the structure is grounded on the bed accurately in position and in orientation by ballasting the structure while using the grounded caisson as a fixed point for positioning and orienting the structure. This method may be used for accurately grounding a foundation for a bridge pier, and it also makes it possible to prefabricate and assemble a bridge superstructure (pier, pylon, deck, shrouds) on land or in a harbor, with the superstructure being temporarily supported on the caisson.

14 Claims, 4 Drawing Sheets

METHOD OF ACCURATELY POSITIONING A PREFABRICATED STRUCTURE ON THE SEA BED OR ON A RIVER BED BY GROUNDING, AND A SEA OR A RIVER CONSTRUCTION OBTAINED BY SAID METHOD

The present invention relates to a method of installing a prefabricated structure on the sea bed or on a river bed, said prefabricated structure being capable of floating, and once afloat, of being towed to the desired site, and then of being grounded on the bottom by being ballasted.

BACKGROUND OF THE INVENTION

Wherever possible when performing construction work at sea or in a river (offshore platforms, sunken tunnels, under river crossings, bridges, etc. . .), use is made of prefabricated structures which are brought on site while afloat and which are then grounded in their final positions.

It is desirable to reduce the amount of work that must be performed on site to as little as possible, and to increase the amount of work performed by prefabrication, since prefabrication takes place on land or in a dry dock and consequently under better conditions of: cost; time taken; quality of work performed; and safety of personnel performing the work.

However, prefabrication can be of limited use only, or of no use at all, when the positioning tolerances required for the work under construction are incompatible with the tolerances which can be achieved by grounding, i.e. tolerances of one to several meters. This is particularly true for multi-span bridges, in which the positioning tolerances required for the piers, the pylons, and the spans have an order of magnitude of about ten centimeters. In this case, either the entire work is constructed on site, or else prefabrication is limited to a portion of the work with the rest of it then being constructed on the final site. For example a foundation may be prefabricated and grounded to within plus or minus two meters, with a pier then being constructed on the grounded foundation to the required tolerance. However, when this is done, and given the relatively poor accuracy with which the prefabricated foundation can be positioned by grounding, it is sometimes necessary to provide a foundation of sufficiently large size to ensure that after it has been grounded, the bridge pier can subsequently be built on the foundation in a position and at an orientation both of which are accurate relative to other piers of the bridge which have already been constructed. As a result, the prefabricated foundations must be larger in size than would be strictly necessary for receiving a bridge pier. In addition, even if a portion of the work can be prefabricated on land, a large quantity of the work remains to be done on the final site (pier construction,pylon construction or mounting, installing the bridge deck or spans, etc. . .).

There are several causes for poor accuracy in grounding maneuvers (one to several meters). Firstly, it is practically impossible to hold a floating structure totally still while the structure is subjected to the action of swell and of currents. The structure which is to be held still by mooring lines prior to grounding is nevertheless subjected to motion which is more or less periodic with amplitude which is a function of the stiffness of the mooring lines and of the forces due to currents, swell, and wind. The amplitude of such motion may be reduced by shortening the mooring lines (or by increasing their stiffness), but in that case the forces in the mooring lines also increase and a limit is rapidly reached due to the strength of the mooring devices (cables, anchors, mooring blocks, etc.). Further, the lack of a fixed reference point makes position-determining operations difficult and inaccurate, thereby making guidance and positioning prior to grounding difficult and inaccurate.

The main aim of the present invention is thus to provide a method enabling a prefabricated structure to be grounded, and in particular enabling a foundation for a bridge pier to be grounded, with the structure being grounded accurately both in position and in orientation on the sea bed or on a river bed.

SUMMARY OF THE INVENTION

The present invention provides a method of installing a prefabricated structure on the sea bed or on a river bed, said prefabricated structure being capable of floating and, when afloat, of being towed to the desired site, and of being grounded on the bed by being ballasted, the method consisting in at least partially surrounding said prefabricated structure by a floating caisson while leaving a gap of several meters between the caisson and the structure, then in giving the floating assembly constituted by the caisson and the structure a suitable approximate position and location while said assembly is located at the site where the structure is to be grounded, then in grounding the caisson on the bed by ballasting the caisson, and subsequently in grounding the structure on the bed with an accurate position and orientation by ballasting said structure while using the grounded caisson as a fixed point for positioning and orienting the structure.

BRIEF DESCRIPTION OF THE DRAWINGS

Embodiments of the invention are described by way of example with reference to the accompanying drawings, in which.

MORE DETAILED DESCRIPTION

Figure 1:
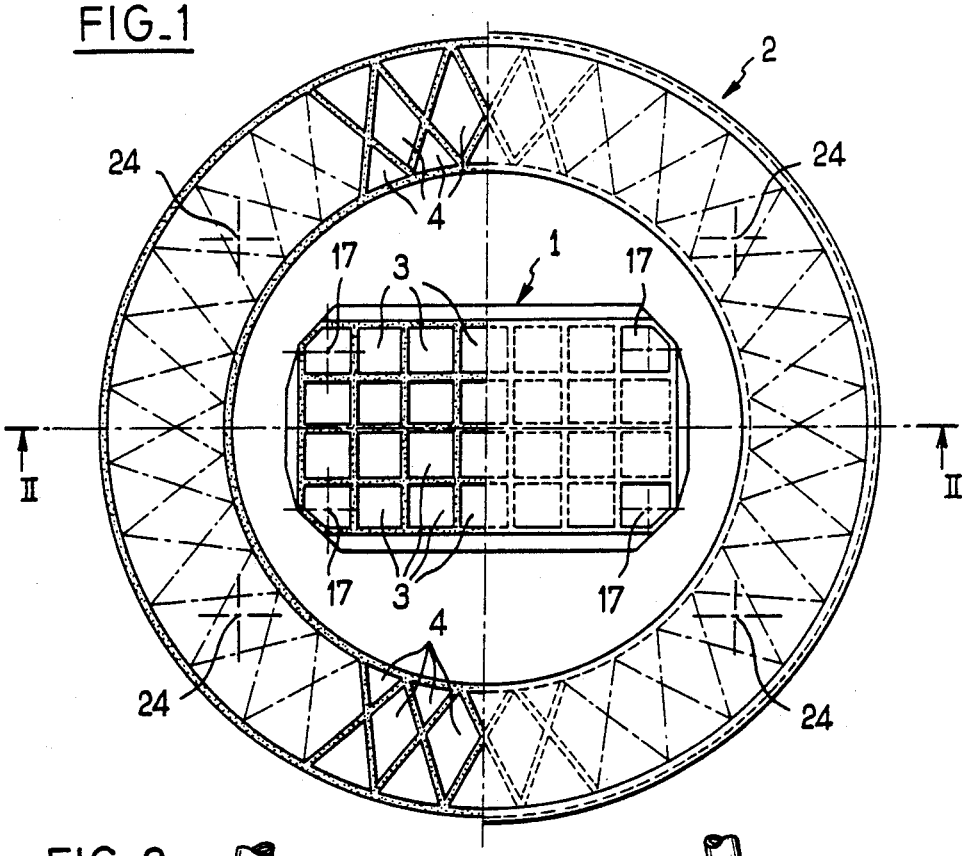
FIG. 1 is a plan view, half in horizontal section, of a prefabricated foundation for a bridge pier, together with a prefabricated caisson for use in placing the foundation on the sea bed or on a river bed.
Figure 2:
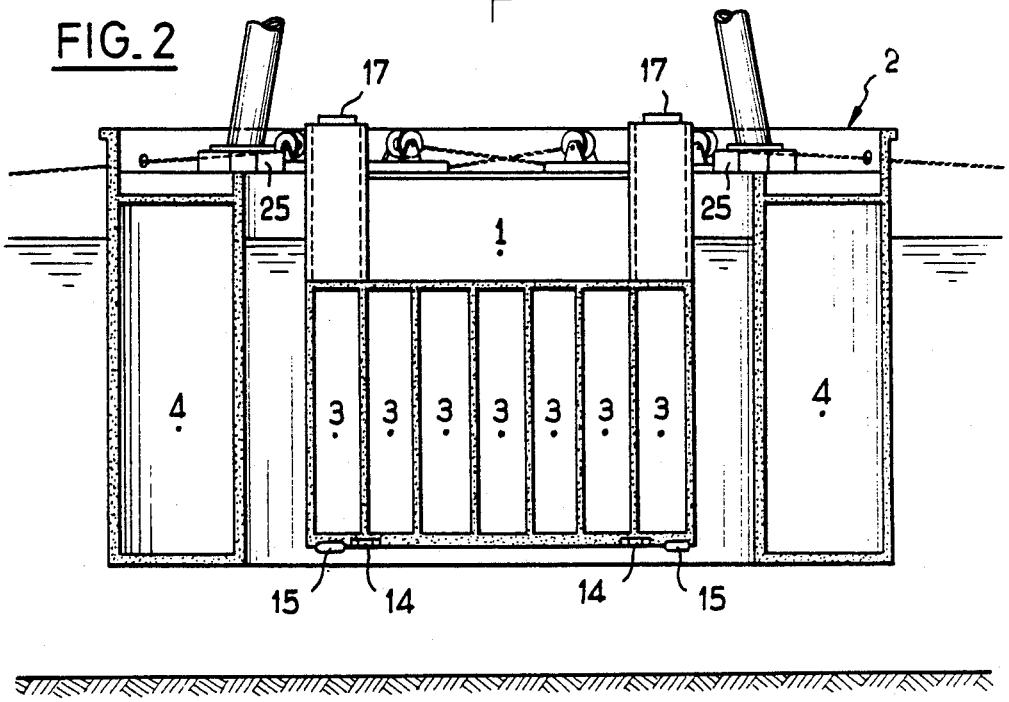
FIG. 2 is a section on line II—II of FIG. 1.

FIGS. 1 and 2 show, by way of example, a prefabricated foundation 1 for supporting a bridge pier, the foundation being surrounded by a prefabricated caisson 2 which is ring-shaped when seen from above, with the ring being preferably closed, and which leaves a considerable radial gap (at least two meters) around the foundation. The foundation 1 and the caisson are both in the form of hollow structures made of metal or concrete, or partially of metal and partially of concrete, and including respective compartments 3 and 4, thereby enabling the structures 1 and 2 to float when filled with air, while enabling said structures to be grounded when filled with water or solid material (sand, gravel, concrete, etc.). Openings (not shown) may be provided near the bottoms of the compartments 3 or of the compartments 4 to enable similar compartments to communicate with one another. As is known in the art of grounding, at least some of the compartments 3 and 4 in each prefabricated structure are provided with valves and pumps (not shown) enabling the compartments 3 and 4 to be filled with water (ballasting) or to be emptied.

Figure 10:
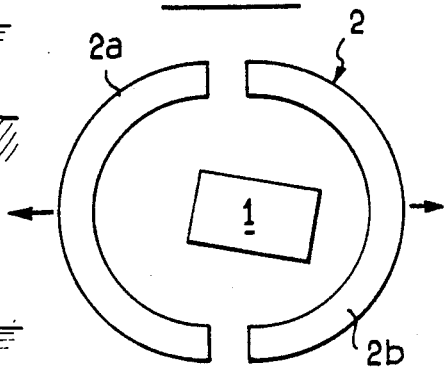

The foundation 1 and the caisson 2 are prefabricated on land or in a dry dock. The caisson 2 may be made as a single part as shown in FIG. 1, in which case the foundation 1 and the caisson 2 are constructed on the same site, or else the caisson 2 may be constructed in two parts 2*a* and 2*b* (see FIGS. 10 and 17) suitable for being fixed to each other in a detachable manner, in which case the foundation 1 and the caisson 2 may be constructed on separate sites. In either case, the caisson 2 may be built first, and then floated and towed to a dock in which it is grounded, after which the water contained in the inside volume of the caisson may be removed, thereby enabling the caisson itself to serve as a dry dock for constructing the foundation 1.

Figure 4:
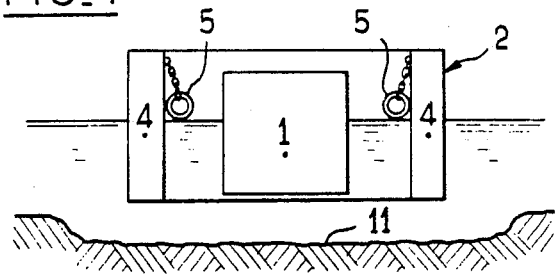

Once the foundation 1 has been constructed and floated, the caisson 2 is placed around the foundation 1 if it was not already therearound, and it too is floated. Thereafter, the foundation 1 and the caisson 2 are towed together to the site where the foundation 1 is to be grounded on the sea bed or on a river bed. At least during this towing stage, fenders 5 (see FIG. 4) are disposed between the foundation 1 and the caisson 2 in order to prevent them bumping into each other. Preferably, during this towing stage, the foundation 1 and the caisson 2 are also moored to each other by cables (not shown) in order to limit relative motion therebetween as much as possible.

Figure 3:
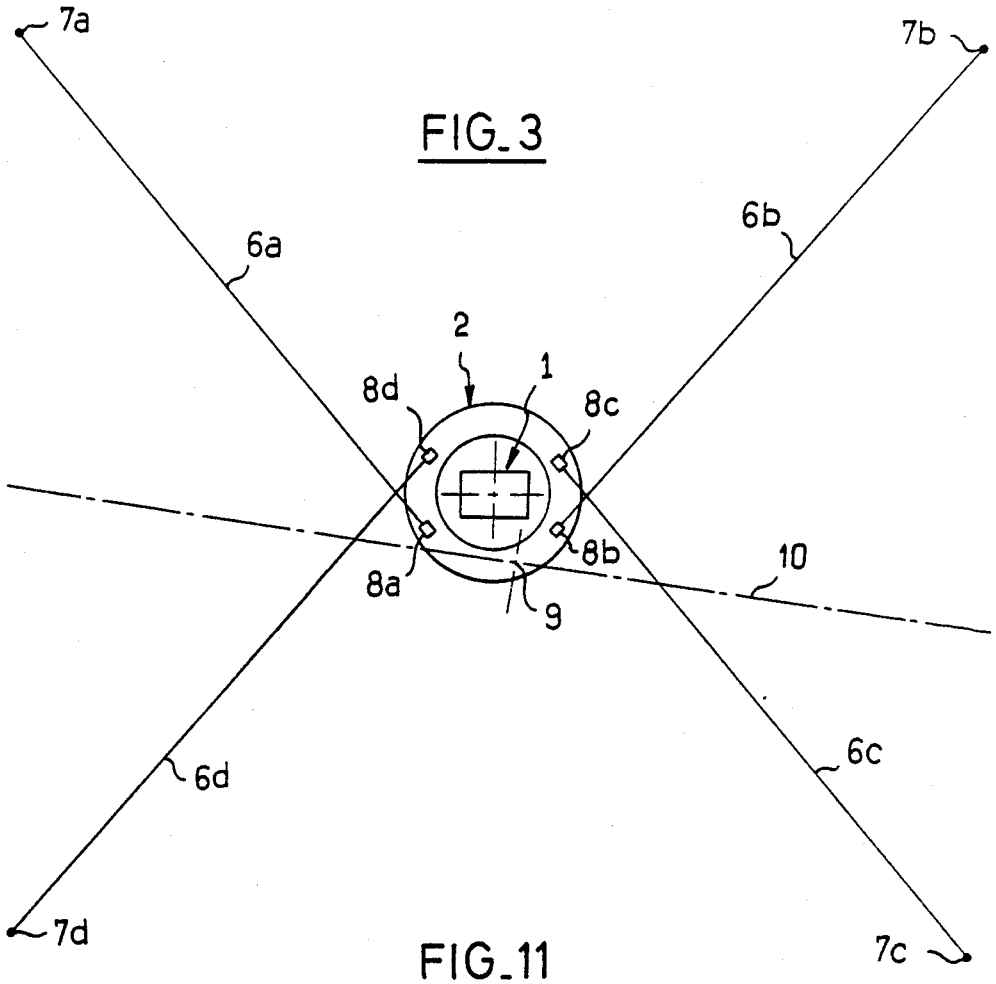
FIGS. 3 to 10 are diagrams, some in plan view and some in vertical section, showing various stages in the method of the present invention.

Once the foundation 1 and the caisson 2 have been brought over the site where the foundation 1 is to be grounded, and while the foundation 1 is still moored to the caisson 2, the caisson 2 is connected by a plurality of mooring lines, e.g. four lines 6*a* to 6*d* (FIG. 3), to a corresponding number of anchor points 7*a* to 7*d*, such as underwater anchoring piles which have already been installed and buoyed. Although FIG. 3 shows only four mooring lines 6*a* to 6*d*, a larger number of lines could be provided if necessary. The opposite end of each mooring line 6*a* to 6*d* is connected to a corresponding winch 8*a* to 8*d* installed on the caisson 2. FIG. 3 also shows at 9 the desired position and at 10 the desired orientation for the foundation 1, axis 10 being, for example, the longitudinal axis of a bridge to be constructed.

The mooring lines 6*a* to 6*d* and the winches 8*a* to 8*d* are used to adjust the position and the orientation of the assembly constituted by the foundation 1 and the caisson 2 so that they coincide approximately with the position determined by the point 9 and the axis 10. This adjustment operation may also be performed using optical measurement systems, e.g. laser-sighting systems, using fixed reference points situated on the ground or on structures such as other bridge piers which have already been installed.

Figure 6:
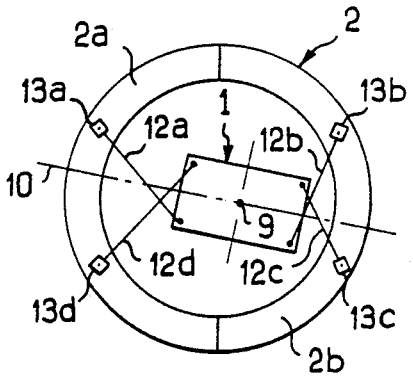
Figure 5:
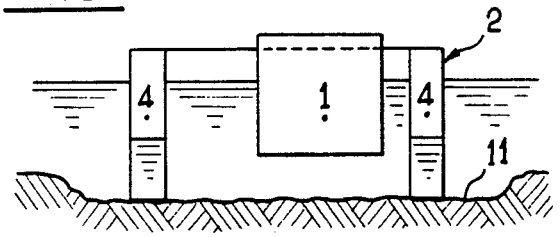

Once the position and the orientation of the foundation 1 and the caisson 2 have been adjusted as described above, grounding operations may commence. Starting from the position shown in FIG. 4, where both the foundation 1 and the caisson 2 are floating, the compartments 4 in the caisson 2 are filled with water as shown in FIG. 5 in order to ground the caisson 2 on the bed 11 of the sea or of a river. Because of the various factors mentioned above (currents, swell, wind), the accuracy with which the caisson is grounded is relatively poor (about±2 m). It is therefore necessary to ground the foundation 1 so that its position and orientation are much more accurate in order to be compatible with the positioning tolerances required for the work under construction. To this end, a sufficient quantity of water is put into the compartments 4 of the caisson 2 to ensure that, once it has grounded, the caisson 2 is stable in position on the bed 11, i.e. to ensure that currents, swell, and wind cease to influence the position of the caisson 2. Thereafter, the position and the orientation of the foundation 1 are adjusted in such a manner as to cause them to coincide with the point 9 and the axis 10 (FIG. 6). This adjustment may be performed, for example, by using mooring lines 12*a* to 12*d* and corresponding winches 13*a* to 13*d* installed on the caisson 2. The winches 13*a* to 13*d* can optionally be the same winches as the winches 8*a* to 8*d* which were used previously for roughly positioning the caisson 2 by means of the mooring lines 6*a* to 6*d*. Under such conditions, the position and the orientation of the foundation 1 can be adjusted with good accuracy (about±10 cm), i.e. with accuracy compatible with the positioning tolerances required for constructing a bridge. The position and the orientation of the foundation 1 are adjusted by using the caisson 2 as a fixed point since, once it has itself been grounded, it is perfectly stable in position. Further, since the foundation 1 is now sheltered by the grounded caisson 2, it is no longer subjected to the effects of currents and swell. Finally, given that the caisson 2 is relatively close to the foundation 1, the mooring lines 12*a* to 12*d* are considerably shorter than the mooring lines 6*a* to 6*d* and are consequently much stiffer.

Figure 7:
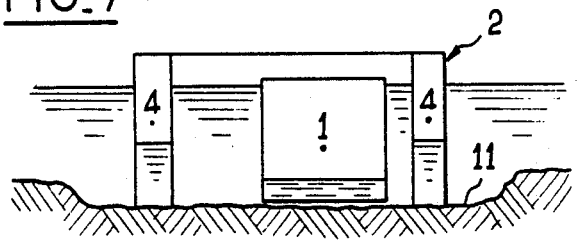

It should be noted that the position and the orientation of the foundation 1 may be accurately adjusted while the foundation 1 is still afloat (FIG. 5) or after the compartments 3 in the foundation have been filled with water (FIG. 7). In this case, the amount of water initially inserted into the compartments 3 in the foundation 1 is just sufficient to ensure that the bottom of the foundation is in the immediate proximity of the bed 11 without coming into contact therewith.

Figure 8:
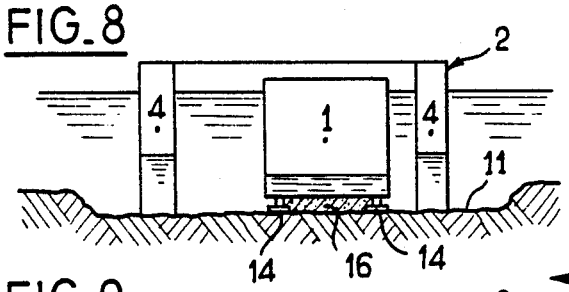
Figure 9:
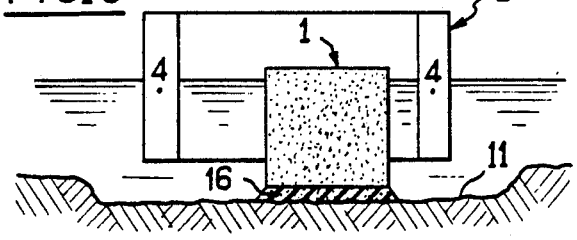

After the position and the orientation of the foundation 1 have been accurately adjusted, the foundation is ballasted with just enough ballast to ground it on the bed with low apparent weight. The trim, the list, and the level of the foundation 1 are then adjusted. This adjustment operation may be performed using any of the conventional grounding techniques, for example a plurality of jacks 14 (see FIG. 8) and/or a plurality of cushions 15 (FIG. 2) initially provided around the periphery of the base of the foundation 1. When cushions 15 are used, they are "inflated" with cement. Then, once the trim, the list, and the level of the foundation have been adjusted, cement is injected under the foundation 1 between the foundation and the bed 11 in order to create a foundation seating 16. Once the cement in the seating 16 has set, the foundation 1 is finally held in place on the bed 11 either by gravity by providing the foundation 1 with additional ballasting (e.g. by filling its compartments 3 with an additional quantity of water or with sand, gravel, or concrete, as shown in FIG. 9), or else by anchoring it using piles forced into the bed 11 and fixed to the foundation 1.

Thereafter, either the caisson 2 is left in place, optionally after being re-centered relative to the foundation 1 in a manner described below, or else, if the caisson 2 is made of two detachable portions 2*a* and 2*b*, it may be re-floated by pumping the water out from its compartments 4 (FIG. 9), and its two parts 2*a* and 2*b* may be detached from each other, separated from the foundation 1 (FIG. 10), and reused for installing another structure or foundation in a manner similar to that described above.

In prior art grounding techniques, and as mentioned above, since the accuracy with which the foundation could be grounded was relatively poor, it was necessary to construct the remaining components of a bridge (and in particular its piers or towers) on site on the foundations after they had been grounded. Given that the method of the present invention makes it possible to ground a foundation 1 with much greater accuracy than is possible with prior art grounding techniques, it is now possible to prefabricate on land not only the foundation 1 together with its supports 17 (see FIGS. 1 and 2) for receiving a bridge pier, but also the pier itself, together with the pylon and maybe even the deck of the bridge.

If the foundation has sufficient buoyancy to support the superstructure, the superstructure may be prefabricated and assembled on land or in a port on its foundation and then the assembly may be towed, positioned, and grounded as described above.

However, if the foundation does not have sufficient buoyancy to support its superstructure, use may be made of the greater buoyancy of the caisson, as follows.

Figure 11:
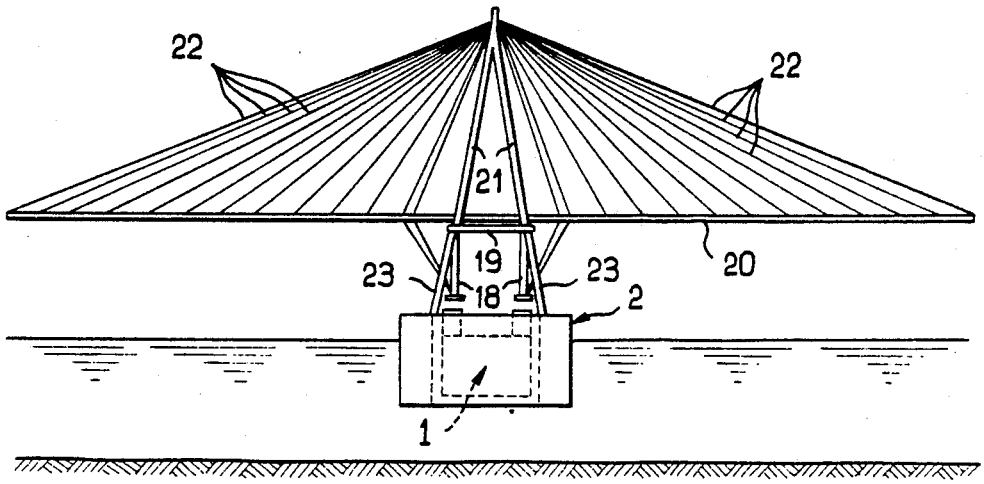
FIG. 11 is a side elevation of a prefabricated bridge component capable of being placed on the sea bed or on a river bed by the method of the present invention.

In the following description, the bridge pier is assumed to be constituted, for example, by four tubular legs 18 (FIG. 11) at a spacing corresponding to the spacing of the supports 17 on the foundation 1 (FIGS. 1 and 2), together with a support structure 19 for the bridge deck 20. The support structure 19 is fixed to the top ends of the legs 18 and may be constituted, for example, by a horizontal frame whose sides are formed by tubular components or by appropriate beams. In the example shown in FIG. 11, the pylon 21 is constituted by four tubular elements whose lower ends are fixed to the support structure 19 and whose top ends are brought together and fixed to one another so as to form a kind of pyramid. The deck 20 is mounted in a double cantilever fashion on the support structure 19, and shrouds 22 extend between the deck 20 and the top of the pylon 21. The pier 18, 19, the deck 20, the pylon 21, and the shrouds 22 are assembled in a harbour after the caisson 2 has been constructed, either while it is still in a dry dock, or else after it has been temporarily grounded on the bed of a wet dock. The four legs 18 and the support structure 19 are initially mounted on the caisson 2 by means of temporary legs 23 whose lower ends rest on the caisson 2 at points 24 (FIG. 1) previously provided for this purpose, via supports 25 which may be adjusted in height and optionally in horizontal position by means of hydraulic jacks and sliding bottom plates. Thereafter the pylon 21 and the deck 20 are mounted on the support structure 19 and the shrouds 22 are suitably tightened.

Figure 12:
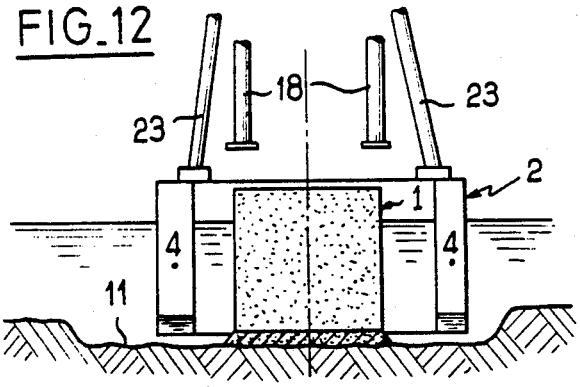
FIGS. 12 to 16 are diagrams showing various stages in the installation of the bridge component shown in FIG. 11.
Figure 13:
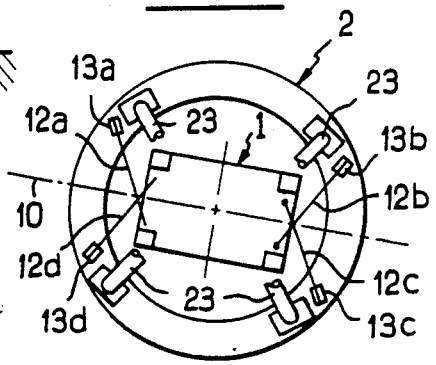

Then, the foundation 1 and the caisson 2 supporting the superstructure 18–22 are floated and towed to the site where the foundation 1 is to be grounded. Then, the foundation 1 is grounded accurately in position and orientation in the manner described above with reference to FIGS. 3 to 9. Once the foundation 1 has been finally grounded, the caisson 2 is slightly re-floated by partially unballasting its compartments 4 so that the caisson is raised a few tens of centimeters above the bed 11 as shown in FIG. 12. Then, the caisson 2 is recentered relative to the foundation 1 using the foundation as a fixed reference point. At the same time, the caisson 2 is suitably oriented so that the legs 18 of the bridge pier come over the respective supports 17 on the foundation 1 and so that the deck 20 is properly aligned with the axis 10 (FIG. 13), i.e. with the desired longitudinal axis for the bridge if this is the first bridge component to be installed, or else with the other components which have already been installed. As shown in FIG. 13, the position and the orientation of the caisson can be adjusted, for example, by using the same mooring lines 12*a* to 12*d* and the same winches 13*a* to 13*d* as were previously used for positioning and orienting the foundation 1.

Figure 14:
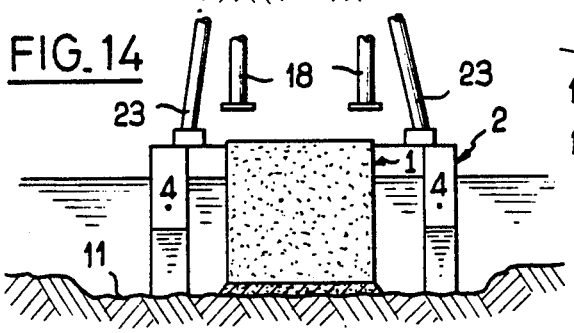

Once the the caisson 2 has been correctly positioned and oriented, its compartments 4 are again filled with water so as to ground it on the bed 11 (FIG. 14). Then, using the adjustable supports 25 (FIG. 15), the level (and if necessary the position and the orientation) of the superstructure 18–22 is(are) accurately adjusted using the grounded caisson 2 as a fixed reference point and in such a manner as to ensure that the position, the orientation, and the level of the superstructure are correct relative to the foundation 1 and also relative to any other bridge components which have already been installed. These adjustments may be performed accurately using the adjustable supports 25 and the above-mentioned optical measuring systems, e.g. laser sighting systems.

Figure 15:
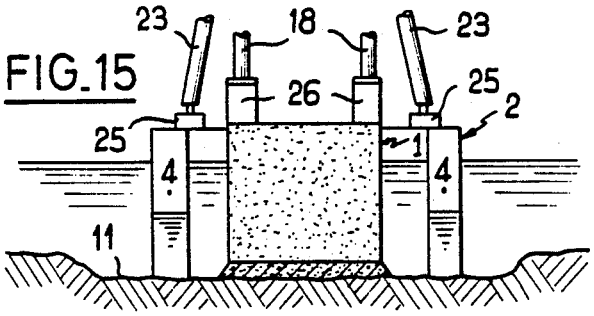

Then, the legs 18 of the bridge pier are fixed to the foundation 1, e.g. by welding, by bolting, or by casting concrete in situ as shown diagrammatically at 26 in FIG. 15. Then, the weight of the superstructure 18–22 is transferred to the foundation 1, for example by retracting the piston rods of hydraulic jacks contained in the adjustable supports 25. Then, the temporary legs 23 are detached from the support structure 19 and from the caisson 2, and they are then removed and either demolished or else re-used in order to support other superstructures on other caissons. Similarly, the mooring lines 12*a* to 12*d*, the winches 8*a* to 8*d*, and 13*a* to 13*d*, and the adjustable supports 25 can be dismounted and removed for re-use on another caisson.

When the caisson 2 is in two detachable parts 2*a* and 2*b*, the caisson 2 may be re-floated by deballasting its compartments 4, and its two parts 2*a* and 2*b* may be disassembled, separated from the foundation 1 and re-used for installing another foundation.

Figure 16:
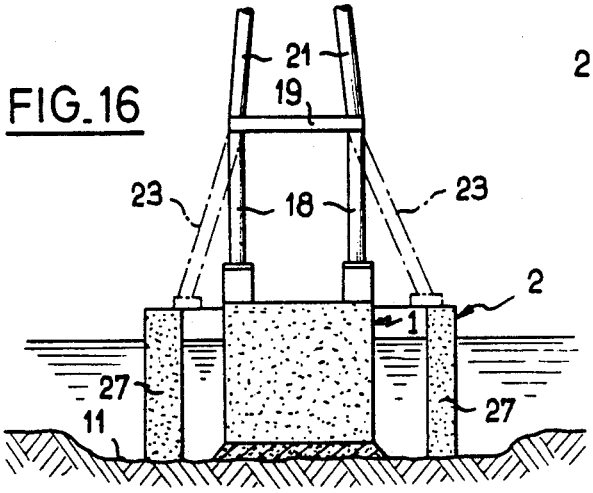

However, the caisson 2 may advantageously be left in place so as to protect the foundation 1 against possible collisions with shipping. In this case, the caisson 2 is further ballasted by filling its compartments 4 with an additional quantity of water or sand or gravel or concrete or any other heavy filler material as shown at 27 in FIG. 16. Alternatively, the caisson 2 may be anchored to the bed 11, for example by means of piles suitably thrust into the bed 11 and fixed to the caisson 2. It may be observed that the additional ballasting or anchoring of the caisson 2 may be performed immediately after the caisson 2 has been grounded (FIG. 14) and before the position, the orientation, and the level of the superstructure 18–23 have been accurately adjusted, or else at any convenient time after this accurate adjustment has been performed.

Figure 17:
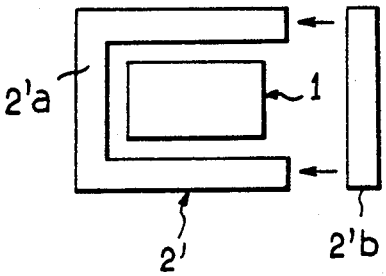
FIG. 17 is a diagrammatic plan view of another form of caisson suitable for use in implementing the present invention.

FIG. 17 is a plan view of another form of floating caisson 2' suitable for use in implementing the method of the present invention. As shown in FIG. 17, the caisson 2' may be rectangular in shape and may be constituted by a single part or by two parts 2'*a* and 2'*b* which are fixed to each other in a detachable manner so that when the foundation 1 and the caisson 2' are constructed independently from each other on different sites, the caisson 2' may be placed around the foundation1 after they have both been floated.

Naturally the implementations described above are given purely by way of example and are not limiting, and in particular numerous modifications can easily be provided by any person skilled in the art without thereby going beyond the scope of the present invention. Thus, in particular, if the caisson 2 or 2' is made of two detachable parts, the caisson 2 or 2' may be placed around the structure 1 not in a harbour, but outside the harbour or on the site where the structure 1 is to be grounded, with the structure 1 and the caisson 2 or 2' being towed to the site separately before being brought together. In addition, although the present invention is described above with respect to accurately grounding a foundation for a bridge pier, the method of the present invention is also applicable to positioning other structures which may be grounded on the sea bed or on a river bed: e.g. it may be applied to prefabricated undersea tunnel components. In this case, the caisson 2 need not completely surround the structure 1 and may be constituted, for example, solely by the part 2'*a* shown in FIG. 17.

I claim:

1. A method of installing a floating prefabricated structure in a sea or river bed at a desired site, the method comprising:

at least partially surrounding said prefabricated structure with a floating caisson;

maintaining a substantial gap between said caisson and said prefabricated structure;

towing said caisson and said prefabricated structure to said desired site;

grounding said caisson on said sea or river bed by ballasting said caisson so that said caisson is fixed on said sea or river bed and shelters said structure;

adjusting the location and orientation of said prefabricated structure with respect to the grounded caisson as a fixed reference; and ballasting said prefabricated structure so that said structure is grounded on said sea or river bed.

2. The method of claim 1, wherein said adjusting step comprises appropriately manipulating a linking system which connects said structure to said caisson.

3. The method of claim 1, further including the step of adjusting the location and orientation of said caisson and said prefabricated structure prior to said caisson grounding step.

4. The method of claim 1, wherein said structure adjusting step takes place while said prefabricated structure is afloat and prior to said ballasting step.

5. The method of claim 1, further including the step of partially ballasting said prefabricated structure prior to said structure adjusting step so that the bottom of said structure is adjacent to said sea or river bed.

6. The method of claim 1, further including the step of injecting cement under said prefabricated structure.

7. The method of claim 6, further including the step of additionally ballasting said prefabricated structure after said injecting cement step.

8. The method of claim 6, further including the step of anchoring said prefabricated structure to the sea or river bed after said injecting cement step.

9. The method of claim 1, further including the steps of re-floating said caisson and disconnecting said caisson from said prefabricated structure after said prefabricated structure is grounded so that said caisson may be re-used.

10. A method for installing a floating prefabricated structure in a sea or river bed at a desired site, said prefabricated structure supporting a non-floating superstructure, the method comprising:

prefabricating the superstructure on land;

mounting said superstructure on a caisson by means of a temporary support structure;

at least partially surrounding said prefabricated structure with said caisson;

maintaining a substantial gap between said caisson and said prefabricated structure;

towing said caisson and said prefabricated structure to said desired site;

grounding said caisson on said sea or river bed by ballasting said caisson so that said caisson is fixed on said sea or river bed and shelters said prefabricated structure;

adjusting the location and orientation of said prefabricated structure;

ballasting said prefabricated structure so that said structure is fixed on said sea or river bed;

partially deballasting said caisson so that said caisson is lifted slightly above said sea or river bed;

adjusting the location and orientation of said caisson;

re-ballasting said caisson so that said caisson is re-grounded on said sea or river bed;

adjusting the location and orientation of said superstructure;

transferring the weight of said superstructure to said prefabricated structure;

connecting said superstructure to said prefabricated structure;

detaching said temporary support structure from said superstructure; and removing said support structure from said caisson.

11. The method of 10, wherein said prefabricated structure adjusting step and said caisson adjusting step comprise appropriately manipulating a linking system which connects said prefabricated structure to said caisson.

12. The method of claim 10, further including the step of adjusting the location and orientation of said caisson and said prefabricated structure prior to said caisson grounding step.

13. The method of claim 10, further including the steps of re-floating said caisson after said removing step and disconnecting said caisson from said prefabricated structure so that said caisson may be re-used.

14. The method of claim 10, further including the step of further ballasting said caisson so that said caisson is fixed on said sea or river bed and shelters said prefabricated structure.

* * * * *